United States Patent [19]

Baggott et al.

[11] Patent Number: 4,624,301

[45] Date of Patent: Nov. 25, 1986

[54] GAS CONVECTION OVEN WITH EGG-SHAPED HEAT EXCHANGER TUBE

[75] Inventors: George T. Baggott, Cleveland; Myron T. Cooperrider, North Royalton, both of Ohio

[73] Assignee: Crescent Metal Products, Inc., Cleveland, Ohio

[21] Appl. No.: 636,484

[22] Filed: Aug. 1, 1984

Related U.S. Application Data

[62] Division of Ser. No. 418,056, Sep. 14, 1982, Pat. No. 4,484,561.

[51] Int. Cl.[4] ..... F24H 3/08; F28F 1/02

[52] U.S. Cl. ..... 165/47; 165/122; 165/177

[58] Field of Search ..... 165/124, 122, 172, 182, 165/151, 177, 47

[56] References Cited

U.S. PATENT DOCUMENTS

| | | | |
|---|---|---|---|
| 1,528,461 | 3/1925 | Woolfe | 165/151 |
| 1,752,879 | 4/1930 | Anderson | 165/151 |
| 1,775,041 | 9/1930 | Karmazin | 165/151 |
| 1,887,093 | 11/1932 | Harnett et al. | 165/151 |
| 2,011,900 | 8/1935 | Laird | 165/172 |
| 2,262,158 | 11/1941 | Beam | 126/91 |
| 2,399,487 | 4/1946 | Hartwig | 165/124 |
| 2,427,336 | 9/1947 | Askin | 165/151 |
| 2,429,360 | 10/1947 | Kells | 126/91 |
| 2,474,687 | 6/1949 | Parrish | 165/124 |
| 2,617,407 | 11/1952 | Johnson | 126/91 |
| 2,733,899 | 2/1956 | Lehmann | 165/151 |
| 3,324,844 | 6/1961 | Huffman | 126/21 |
| 3,384,068 | 5/1968 | Perry et al. | 126/21 |
| 3,605,717 | 9/1971 | Saver | 126/91 |
| 4,044,751 | 8/1977 | Johnson | 126/91 |

FOREIGN PATENT DOCUMENTS

| | | | |
|---|---|---|---|
| 8101608 | 6/1981 | World Int. Prop. O. | 165/151 |
| 954657 | 4/1964 | United Kingdom | 165/172 |

*Primary Examiner*—Albert W. Davis, Jr.
*Assistant Examiner*—John K. Ford
*Attorney, Agent, or Firm*—Renner, Otto, Boisselle & Lyon

[57] ABSTRACT

A gas-fired convection oven for processing food, for example, having a fan for moving air along a circulatory path over, along and about the food to be processed. A package type gas burner outside the oven is directed into a heat exchanger tube of substantial length extending into the oven. High-temperature exhaust gases are discharged from the burner to be directed through the heat exchanger into the circulatory path of air flowing through the convection oven. Relatively proximate the burner the heat exchanger has a linear portion that is of egg-shaped or elliptical cross section, and that portion is oriented with respect to the outlet of the convection blower and walls of the convection blower chamber to draw air over substantially the entire surface area of such portion for maximum cooling/heat exchange function with respect thereto. The outlet from the flow outlet of the heat exchanger is aerodynamic and is positioned proximate the intake to the convection blower wheel whereby the latter tends to draw the hot gases/-products of combustion through the heat exchanger tube.

2 Claims, 9 Drawing Figures

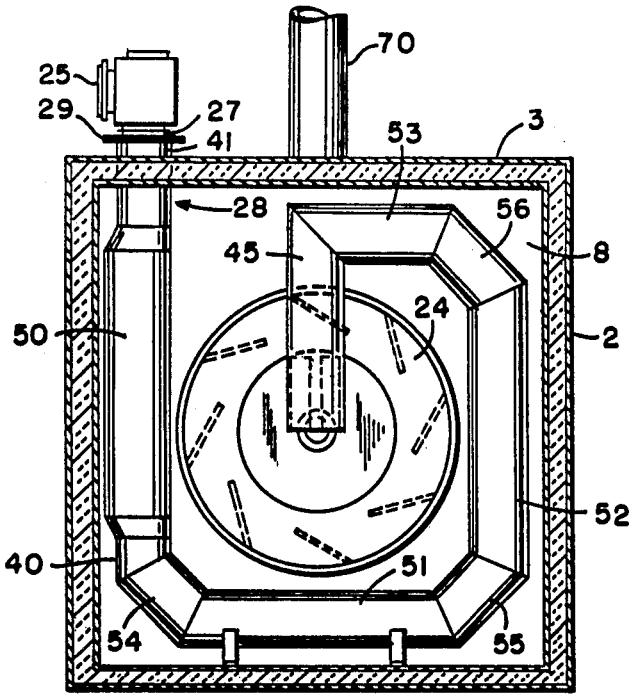
Fig. 3
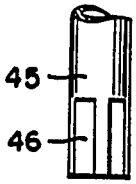
Fig. 5B
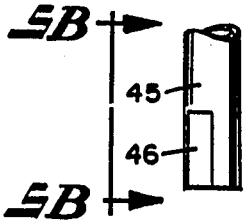
Fig. 5A
Fig. 4
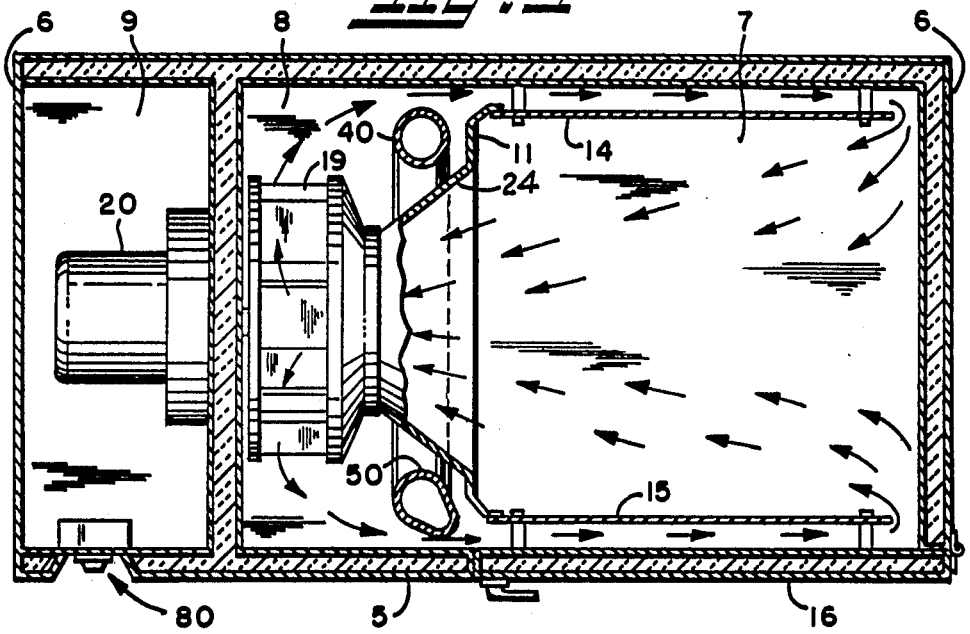

GAS CONVECTION OVEN WITH EGG-SHAPED HEAT EXCHANGER TUBE

This application is a division of application Ser. No. 418,056, filed Sept. 14, 1982, now U.S. Pat. No. 4,484,561, issued Nov. 27, 1984.

TECHNICAL FIELD

The present invention relates generally to heating and more particularly to gas convection ovens, especially those used for heating food, for example for thawing or cooking purposes. In accordance with the preferred embodiment and best mode of the present invention there is disclosed a gas convection oven useful in commercial applications, such as in restaurants, cafeterias, and the like, as opposed to domestic use.

BACKGROUND OF PRIOR ART

In commercial applications for food heating it is necessary to provide relatively large heating compartments for containing food intended for cooking, baking, frying, thawing, etc. It is desirable that heat in such heating compartments be relatively uniformly distributed throughout the same for uniform or controlled heating of product therein. It is desirable, too, that the entire appliance, i.e. a gas convection oven, be capable of being cleaned with relative ease in order to maintain high standards of cleanliness. It also is important to maintain a high degree of reliability of the equipment and facility of servicing the same.

In U.S. Pat. No. 3,605,717 there is disclosed a convection oven in which combustion of gas effects the primary heat input. Disclosure of such patent is incorporated in its entirety by reference. In such patent there is disclosed principles of convection heating in a commercial heating appliance.

Food placed inside a convection oven is processed by moving heated air along a circulatory path directed and arranged to provide throughout the food chamber or heating chamber substantially uniform temperatures of a preselected and controllable level. The circulatory path is generally defined by the walls of the oven, by baffling and by the food supporting means in the food chamber. The air is moved along the circulatory path by a fan or blower usually located adjacent the food chamber in a convection blower chamber. The blower is in the circulatory path.

In the past, the circulated air and gases in convection ovens has been heated by passing them over and around electrically heated coils, steam pipes, heated flues, or tube-like heat exchangers, such as that shown in the noted patent, and relying only upon an exchange of heat between the heating system and the air the desired air temperature in the oven could be maintained. In the noted patent, too, is disclosed the possibility of allowing the products of combustion actually to enter the circulatory air path of the convection oven but this occurs at a limited outlet area of the convection blower air flow. In such patent the burner is of the type that directs a jet of gas into the heat exchanger tube. The inlet to the heat exchanger tube, however, also is open to the atmosphere so that air may be drawn into the heat exchanger tube to support combustion of the gas. The amount of air entering the heat exchanger tube, thus, is uncontrolled, and there is the possibility of unwanted material entering the open inlet of the heat exchanger tube.

The heat exchanger tube disclosed in such patent has several linear lengths connected together at angles to extend generally parallel to several of the walls of the convection blower chamber so that air blown by the convection blower would flow across at least several of those linear tubular extents to be heated by the hot gases flowing through the latter. A conical inlet baffle guides air from the heating or food chamber toward the center or inlet of the convection blower wheel, and a perimeter portion of such baffle and the oven walls guide air flow from the outlet of the convection blower wheel, as such air flows past the heat exchanger, into the heating compartment. Baffles on walls of the heating compartment and the oven walls further guide air flow toward the food or the material therein.

BRIEF SUMMARY OF THE INVENTION

In the present day energy climate, it is desirable to try to optimize energy usage efficiency. In the context of gas convection heating, it is desirable to optimize the thoroughness of the heat exchange process and combustion efficiency. It also is desirable, at the same time, to improve reliability of the convention heating equipment, to facilitate servicing of such equipment, to maintain cleanliness of such equipment, and so on.

With the foregoing and following description in mind, then, one aspect of the present invention relates to a convection oven including a heating compartment, a package gas burner, a heat exchanger for conducting therethrough the products of combustion from combustion of gas initiated at the package gas burner, and a convection blower for blowing air past the heat exchanger for heating thereby and into the heating compartment for heating the same, and the blower including an inlet for drawing in air from the heating compartment for recirculation thereof past the heat exchanger and into the heating compartment.

Briefly, according to another aspect of the invention a convection oven includes a heating compartment, a burner for effecting combustion of gas, a heat exchanger for conducting therethrough the products of combustion from the combustion of gas initiated at the burner, and a convection blower for blowing air past the heat exchanger for heating thereby and into the heating compartment for heating the same, and the heat exchanger including a first tubular portion relatively proximate the burner and having a surface area configuration of a shape and position with respect of air flowing from the blower to draw air blown thereacross so as to flow across substantially the entire extent of such surface area.

According to an additional aspect there is a heating system including a heat exchanger and a heat input source for supplying hot fluid-like material into the heat exchanger for flowing therein, and the heat exchanger has a surface area portion tending to draw fluid flowing over the exterior extent thereof towards such exterior so as to flow over substantially the entire extent of such surface area portion.

According to a further aspect of the invention, a gas convection oven includes a blower compartment having plural walls, the adjacent walls being generally at right angle relation to each other, a heat exchanger for conducting products of gas combustion therethrough, a convection blower for blowing air across the heat exchanger and into a heating area for heating the latter, and a burner for burning gas at an inlet to the heat exchanger, the burner being a powered burner for delivering a forced combination flow of gas and air into the heat exchanger as combustion occurs, and the powered burner and convection blower being cooperatively related to provide substantially complete combustion of the gas.

It is, therefore. a primary object of the present invention to provide improvements in gas convection heating system, particularly ovens, such as those employed in commercial food heating.

Another object is to improve the combustion efficiency in a gas convection oven.

An additional object is to improve the heat transfer efficiency in a gas convection oven.

A further object is to improve the longevity and/or reliability of gas convection oven equipment.

Still another object is to facilitate maintaining a gas convection oven.

Still an additional object is to facilitate maintaining cleanliness of a gas convection oven.

Even another object is to improve the safe operation of a gas convection oven.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF THE DRAWINGS

In the annexed drawings:

FIG. 3 is a transverse section through the preferred embodiment taken in the planes indicated at 3—3 in FIG. 2;

FIG. 4 is a top plan view sectioned on the planes of 4—4 in FIG. 2;

FIGS. 5A and 5B are, respectively, side and back views of the heat exchanger tube outlet;

DETAILED DESCRIPTION OF THE INVENTION

Figure 1:
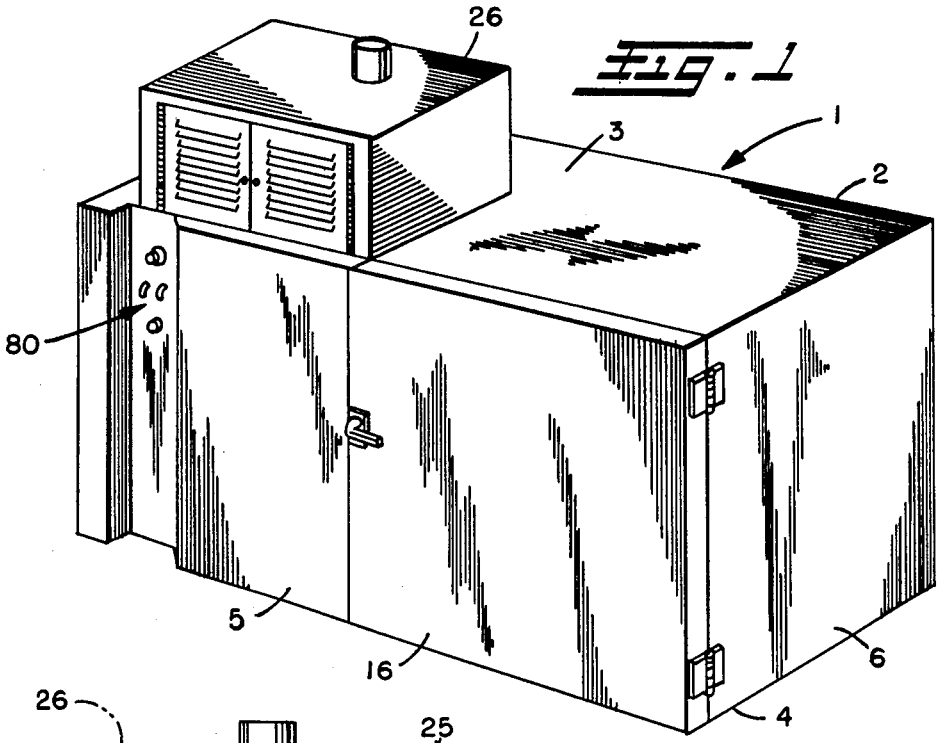
FIG. 1 is a perspective view of a gas convection oven embodying a preferred form of the present invention.

Referring now in detail to the drawings, wherein like reference numerals designate like parts in the several figures, and initially to FIGS. 1–6, a gas convection oven in accordance with the present invention is generally indicated at 1. The oven 1 is formed by a box-like housing 2 having well insulated top, bottom, side and end walls 3, 4, 5 and 6, respectively. The space within the housing 2 is divided into a relatively large heating/-food processing compartment or chamber 7, which takes up a substantial part of the total interior space of the oven 1, a convection blower/heat exchanger chamber 8, and an equipment chamber 9, as is seen most clearly in FIGS. 2 and 4. A wall 10 divides the equipment chamber from the convection blower/heat exchanger compartment 8, and there is a partial separation of the latter and the heating compartment 7 provided by an air inlet baffle 11. The wall 10 preferably is insulated to protect the motor and/or other equipment and controls contained in the equipment chamber 9 from the high temperatures normally present in the other two chambers.

Food to be processed is conveniently placed in the heating chamber 7 through the oven door 12 and onto suitable means, such as trays, racks, etc., that may be removably supported in the heating compartment, for example in the manner shown in the above mentioned patent. Preferably the trays are spaced apart throughout the heating chamber 7 to permit heated air and gases to be freely and uniformly circulated over, around, and about all the goods being processed. It is desirable to provide and to maintain all of the food at a relatively uniform temperatures, and proper arrangement of the trays or similar means contributes to this result. Furthermore, the arrangement of openings 13 in the side wall baffles 14, 15 positioned in the heating chamber 7 to direct air flow from the convection blower compartment 8 into the heating chamber helps control air/temperature distribution in the heating chamber 7, as is described in the above mentioned patent.

The flow of heated air and gases to process the food is provided by a convection blower 18 having a conventional blower wheel 19 driven by an electric motor 20. The motor 20 is mounted on the wall 10 in the equipment chamber 9. The motor extends through the wall 10 and supports the wheel 19 centrally of one end of the food processing/heating chamber 7.

The flow of air provided by the blower is directed in a circulatory path that traverses both the heating chamber 7 and the convection blower/heat exchange chamber 8, importantly, over and around the food to be processed. More particularly, air leaving the wheel 19 generally in a radial flow direction is directed along the front and back sides of the heating chamber 7 and toward the opposite end of the latter relative to the convection blower wheel via side passages provided by the side walls 13 and baffle plates 14, 15. Such circulation is indicated by the several arrows shown in FIG. 4, for example. The baffle plates 14, 15 are spaced from and parallel to the adjacent walls and are preferably supported on posts 22 or other means. The baffle plate 14 is supported on the back wall of the heating chamber 7 and the baffle plate 15 is supported on the door 16 which forms substantially the front wall 13 of the heating chamber 7. The baffle plates 14, 15 are spaced from each other and, accordingly, accommodate in the space therebetween a rack for supporting food to be processed in the heating chamber 7.

The baffle plates 14, 15 terminate short of the end wall 6 so that circulation is continued from the side passages they provide into the central portion of the heating chamber 7 between the baffle plates, as the arrows show in FIG. 4. Openings preferably are provided in the baffle plates 14, 15 to permit secondary air circulation from the side passages into the central portion of the heating chamber to ensure temperature uniformity throughout the space containing the food.

The air circulation path is directed back to the blower 19 by the conical inlet baffle 11 placed between the heating chamber 7 and blower chamber 8 between the side baffle plates 14, 15. The conical central portion 24 of the baffle 11 directs air circulation into the axial air inlet of the blower wheel 19, completing the air circulatory flow path.

Figure 2:
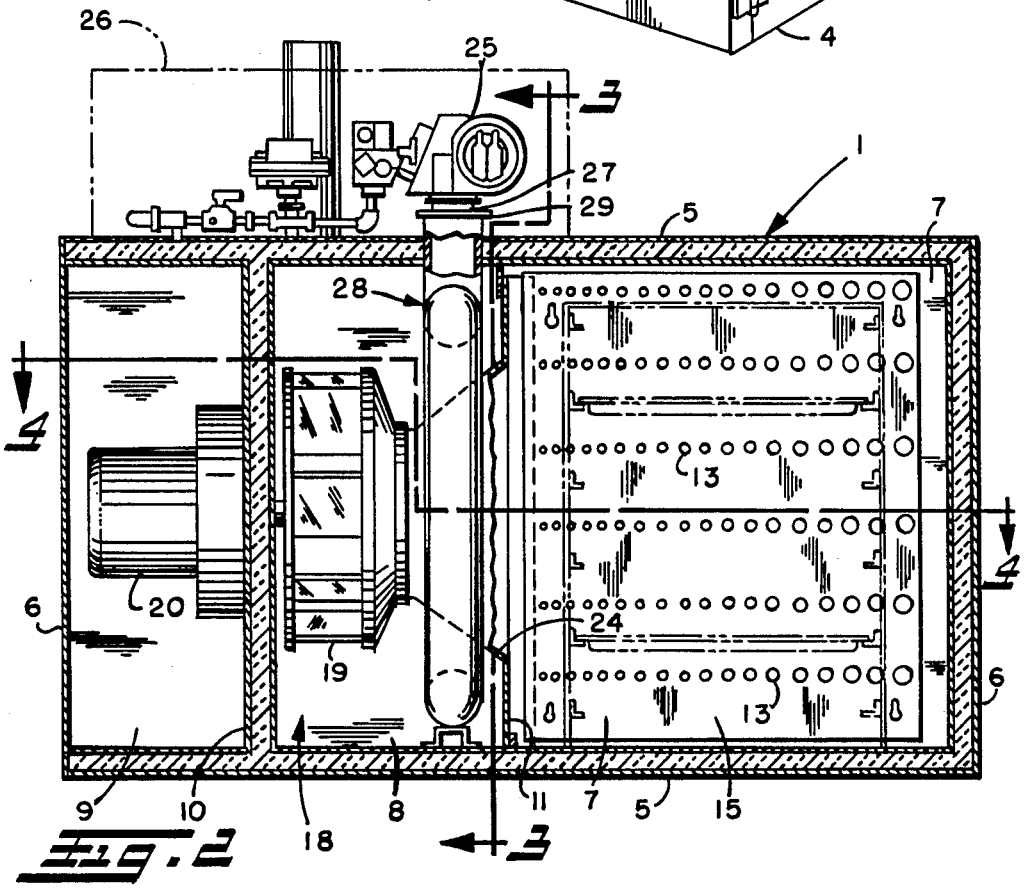
FIG. 2 is a side elevation view of the oven of FIG. 1 and sectioned as indicated.

As is shown in FIG. 2, the baffle plates 14, 15 may have a series of varying diameter openings therein for directing flow directly onto food product in the heating chamber 7 in a uniform manner. Alternatively, slots or other types of openings may be provided in the baffle plates for such purpose.

Heat is preferably provided for the gas convection oven 1 by a package gas burner 25, such as a Model G-2 SD power gas burner manufactured by the R. W. Beckett Corporation, Elyria, Ohio. Such as power gas burner is provided as an integral package that can be mounted externally of the chambers 7, 8 but still be safely housed within a separate compartment 26, for example at the top of the oven 1. The power gas burner includes a pre-mix system that mixes gas and air, pressure controls, a power fan, various electronic controls, electric combustion ignition, and other safety, control and efficiency features.

Using such a package gas burner, the same may be mounted in relatively minimum space that is highly accessible at the top front of the oven 1. Moreover, the outlet 27 from the burner 25 may be coupled directly to the heat exchanger 28 of the present invention via a flange connection 29 that provides a flow path isolated from the external environment and, therefore, avoids the possibility of unnecessary additional air or other foreign material being drawn into the heat exchanger and into the internal portion of the oven 1. The power gas burner, moreover, may be periodically ignited and shut down, for example under control of a conventional thermostat control including a heat sensor located in or proximate to the chambers 7, 8.

Using the power gas burner in accordance with the present invention energy efficiency is improved because there is no escape of heat at the area of the combustion flame. Safe operation is enhanced because of the shielding of the combustion flame, it being confined at the outlet of the power gas burner and in the heat exchanger tube, which will be described in greater detail below. Additionally, the possibility of foreign material entering the heat exchanger tube and subsequently itself burning or contaminating the material in the heating chamber 7 is avoided using the power gas burner/heat exchanger arrangement of the present invention.

Referring now to the heat exchanger 28, which is seen most clearly in FIGS. 2–7, the same is in the form of a tube 40 through which the hot flame and gas products of combustion derived from such flame produced by the gas/air mixture emanating from the power gas burner 25 may flow. Such flame and gas products of combustion effect heating of the heat exchanger tube 40, which is positioned in the path of air flow from the convection blower 18 into the heating chamber 7 thereby to heat such flowing air. The inlet end 41 of the heat exchanger tube 40 is coupled at the flange connection 29 to the power gas burner 25, as was mentioned above. The heat exchanger tube 40 is of a generally spiral shape having respective linear portions joined at angular corners with the respective linear portions being positioned parallel and relatively adjacent front and back side walls, bottom wall, and a portion of the top wall of the convection blower chamber 8. The general shape and operation of the heat exchanger tube 40 is similar to what is described in the above mentioned patent.

Due to the high intensity and substantial heat produced by the gas combustion at the outlet of the power gas burner 25 relative to the cooling effect achieved in the past using an open gun type burner for gas convection ovens, the heat exchanger tube 40 preferably is formed of stainless steel or other high temperature withstanding material. Such material also should have a good thermal conductivity in order to transfer heat from the material flowing therethrough to the air flowing over the external surface area thereof.

Preferably the heat exchanger tube has a gas outlet tubular end 45 having a pair of slot-like cut-outs 46 directly facing into the air inlet area of the convection blower wheel 19. Such tubular outlet extension 45 passes through a cut-out 47 that accommodates the same in the inlet baffle 11. Air flowing around the side of the heat exchanger outlet 45 and being drawn into the convection blower wheel 19 central area tends to draw the gas products of combustion out from the heat exchanger tube and rapidly to disperse the same in the large quantity of air being circulated generally tubulently in the convection blower wheel 19 and area proximate thereto at the outlet thereof. It has been found that using the power gas burner 25, heat exchanger tube 40 and particular outlet 45–46 arrangement of the present invention, copper-oven efficiency is in excess of 90%. Thus, the balance achieved in accordance with the present invention effects a high energy usage efficiency in connection with such combustion. Moreover, because heat is exchanged not only by air passing over the heat exchanger tube 40 but also by the subsequent dispersion of the remaining hot gas products of combustion into the circulating air, energy usage efficiency is appreciable and heat distribution in the oven is uniform. Too, since the combustion process is so thorough, it has been found that the amount of carbon monoxide entering the oven via the heat exchanger tube is very small, thus improving safe operation of the gas convection oven 1 and quality of food preparation therein.

The heat exchanger tube 40, more particularly, includes generally linear portions 50, 51, 52, 53 and the outlet extension 45. Conventional mitred 45° angle elbow joints 54, 55, 56 join respective adjacent linear portions of the heat exchanger tube, as is seen in the several figures. The heat exchanger tube 40 is relatively securely mounted in the convection blower chamber 8 by various mounting brackets, such as those shown at 60, 61, and the slotted opening in the air inlet baffle 11 further secures the heat exchanger tube 40, particularly the outlet 45 thereof in position. The slot-like openings 46 in the outlet of the heat exchanger tube 40 help assure both structural strength of the outlet area where there is a relatively high velocity flow of air directed in a concentrated flow pattern on the curved upstream surface of the outlet 45 on the opposite side of such slot-like openings; and such surface curvature and slot-like openings cooperate to provide an air foil type effect to draw out from the heat exchanger tube 40 gas products of combustion at a flow rate that is proportionately representative of the rate of flow of air produced by the convection blower 19. Therefore, as the blower speed increases or decreases, the negative pressure or drawing out effect relative to the gas products of combustion from the heat exchanger tube 40 will vary in a corresponding fashion.

Figure 6:
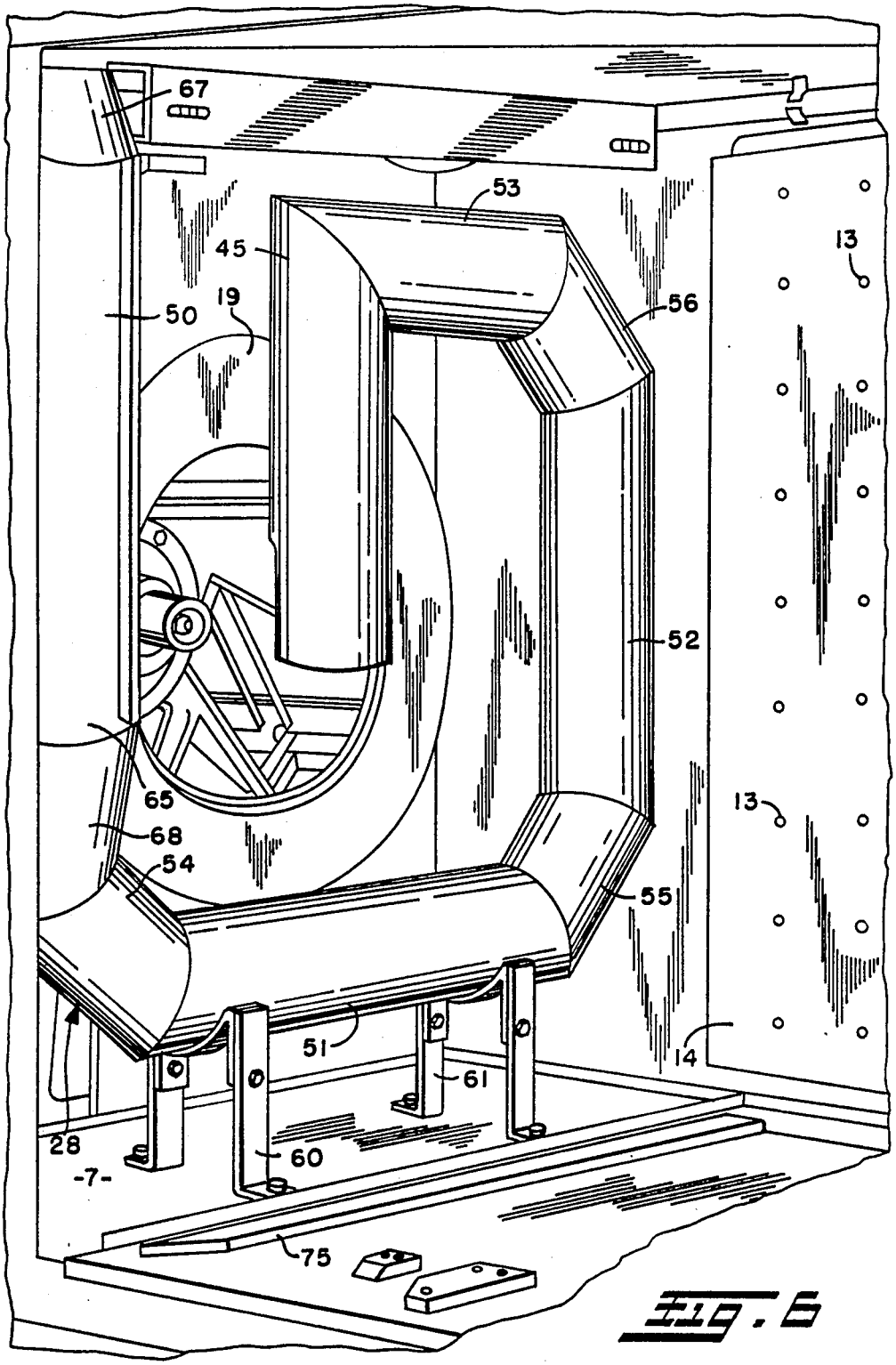
FIG. 6 is an enlarged perspective view of the convection blower/heat exchanger chamber with the inlet baffle and air filter removed.
Figure 7:
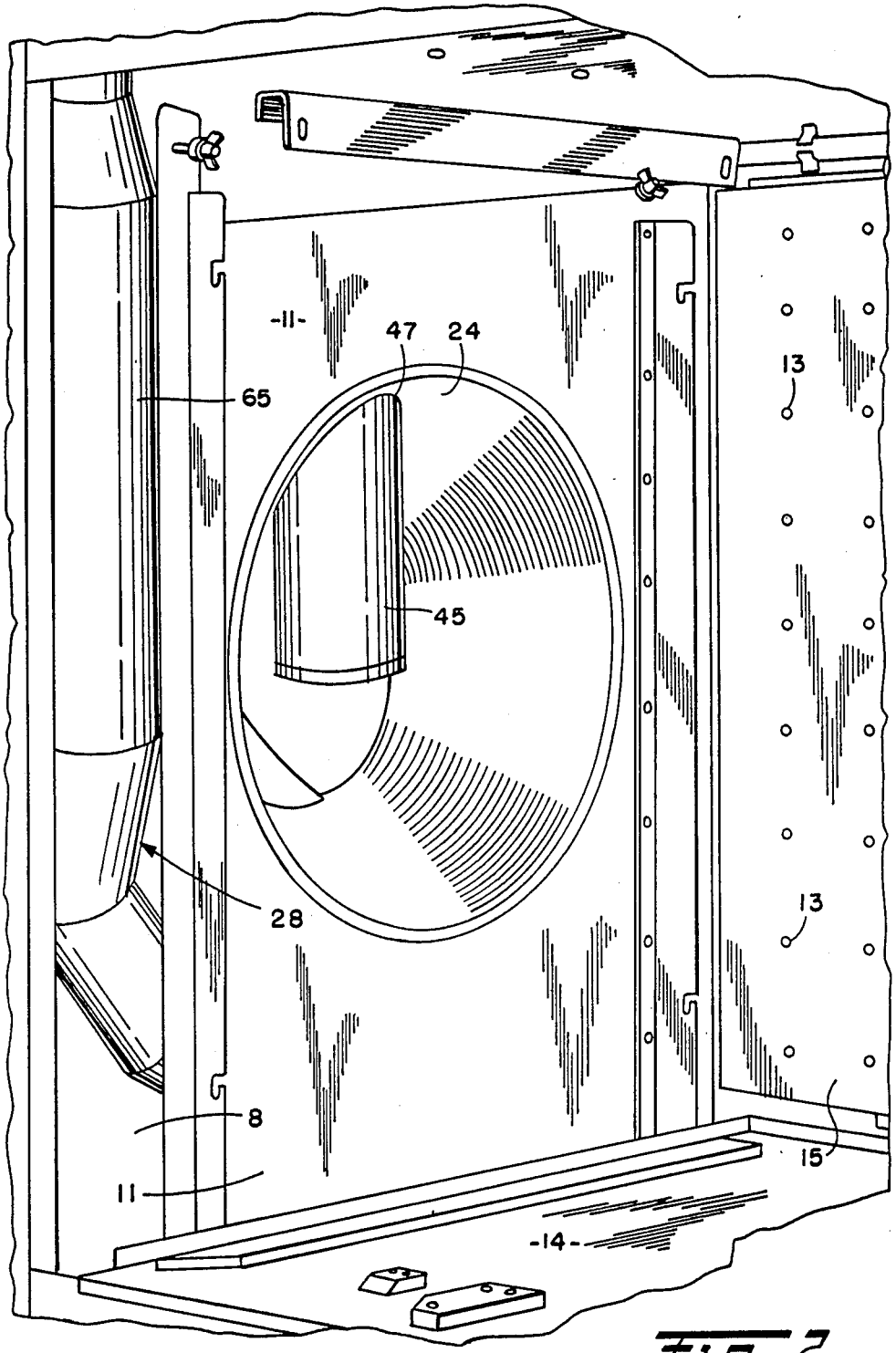
FIG. 7 is an enlarged perspective view looking toward the convection blower/heat exchanger chamber with the conical air inlet baffle ready to be positioned in final assembly relation dividing such chamber from the heating chamber.

Referring, now, particularly to FIGS. 3, 4 and 6, adjacent the inlet portion of the heat exchanger tube 40 is a linear extent of the heat exchanger tube that is not of circular cross section, although the other portions illustrated in the drawings are generally of circular cross section, as can be seen, for example, in FIG. 4. However, the portion 65 is of elliptical or egg-shaped cross section with the axis of the ellipse preferably oriented at a 45° angle with respect to the plane of the adjacent wall 66 of the convection blower chamber 8. The portion 65 has side walls tapering toward each other and rounded end walls connecting opposite ends of the side walls. Neck up and neck down pipe sections 67, 68 couple the elliptical cross section portion 65 of the heat exchanger tube 40 to the respective upstream and downstream portions of the heat exchanger tube 40. It is the purpose of the elliptical cross section portion 65 to provide an external surface area in exposure to the air flowing from the convection blower wheel 19 tending to draw the air flow over substantially the entire extent of such heat exchanger tube portion 65 to maximize the cooling effect of such portion and to obtain maximum thermal energy transfer directly to the air. It has been found that the power gas burner 25 produces so much heat at the area of such portion 65 that the same tends to glow red evidencing substantial heat concentration. Were the portion 65 simply of typical circular cross section of the remaining extent of the heat exchanger tube 40 beyond the portion 65, the downstream back side of such heat exchanger tube would not receive maximum air flow thereon, and in fact would be somewhat shielded from air flow thereon, whereby such back side portion would tend to succumb to heat fatigue prematurely. In contrast, the elliptical cross section portion or other shape that provides a configuration of the external surface area of the portion 65 such that the same would tend to draw maximum air flow thereover would avoid such premature heat fatigue. Further to assure such maximum air flow, the above mentioned preferred 45° angle of the elliptical axis orientation, the larger radial portion of the ellipse being upstream and the narrower radial portion downstream relative to convection air flow direction, and the positioning of the portion 65 in proximity relation to the convection chamber wall and to an adjacent wall portion of the air inlet baffle 11 further assures guidance of the air flow against the entire surface area of the heat exchanger tube portion 65.

Efficient combustion in the heat exchanger tube 40, generally concentrated in the portion 65, releases high amounts of heat, and the same is further promoted by reducing the resistance to gaseous fluid flow through the heat exchanger tube 40. Thus, the negative pressure effect at the outlet 46 enhances such effect even though the total length of the heat exchanger is relatively extensive. The extensive length, however, helps to assure maximum exposure and thermal energy transfer to the air flowing across the heat exchanger and uniformity of distribution of thermal energy during operation of the gas convection oven. The locating of the convection blower wheel 19 centrally in the convection blower chamber 8 and relative to the spiral formation, as seen in FIG. 3, of the heat exchanger tube 40 further helps to balance the system with respect to heat distribution and to optimize thermal energy transfer efficiency. The flow restriction between the elliptical portion 65 and adjacent walls and the wider open areas at other parts of the heat exchanger tube also help balance heat distribution in the heating chamber 7.

The length of the linear extent of the heat exchanger tube directly from the power gas burner 25 preferably is adequate to sheathe the entire flame from the burner 25. This avoids extensive heat concentration at the area where the first bend in the heat exchanger tube 40 occurs.

Heat is introduced into the gas convection oven 1 by the exchange of heat from the heat exchanger tube 40 to the air flowing thereover and directing of that air flow to the heating chamber 7 as well as from the gas products of combustion that enter via the outlet 45 of the heat exchanger tube 40.

An outlet stack or flue 70 allows hot air or other gases to exit the gas convection oven 1 in a controlled manner. The stack 70 may be located in position to pass up through the burner housing portion or compartment 26, as is seen, for example, in FIG. 1, and may be coupled to a conventional vent pipe.

Preferably the power gas burner 25 is positioned at the front top of the oven for access convenience for servicing and to provide maximum unimpeded oven food or other material capacity.

The gas convection oven disclosed and claimed herein is well adapted to processing food, including thawing frozen foods and in addition to being used in the food service industry, may be used for other purposes as well. The side baffle plates 14, 15 and the conical inlet baffle 11 are removably mounted for ease and convenience in cleaning the heating chamber 7 and convection blower chamber 8. Moreover, preferably an air filter, such as a metal filter, provided at the upstream end of the conical air inlet baffle 11 (means for mounting the same being illustrated, for example, at 75 in FIG. 6) to remove particulate material from the circulating air. Moreover, if desired, conventional means may be employed to provide moisture inlet to the heating chamber or convection blower chamber to maintain a desired humidity effect therein, as is well known in the art. Preferably there is no need to provide supplemental air inlet passages for the gas convection oven. Rather, air in the heating chamber 7 and convection blower chamber 8 is continuously recirculated with there being a flow through of gaseous products from the heat exchanger tube into the chamber 7, 8 and, as appropriate, an outflow of gaseous material via the stack.

Figure 8:
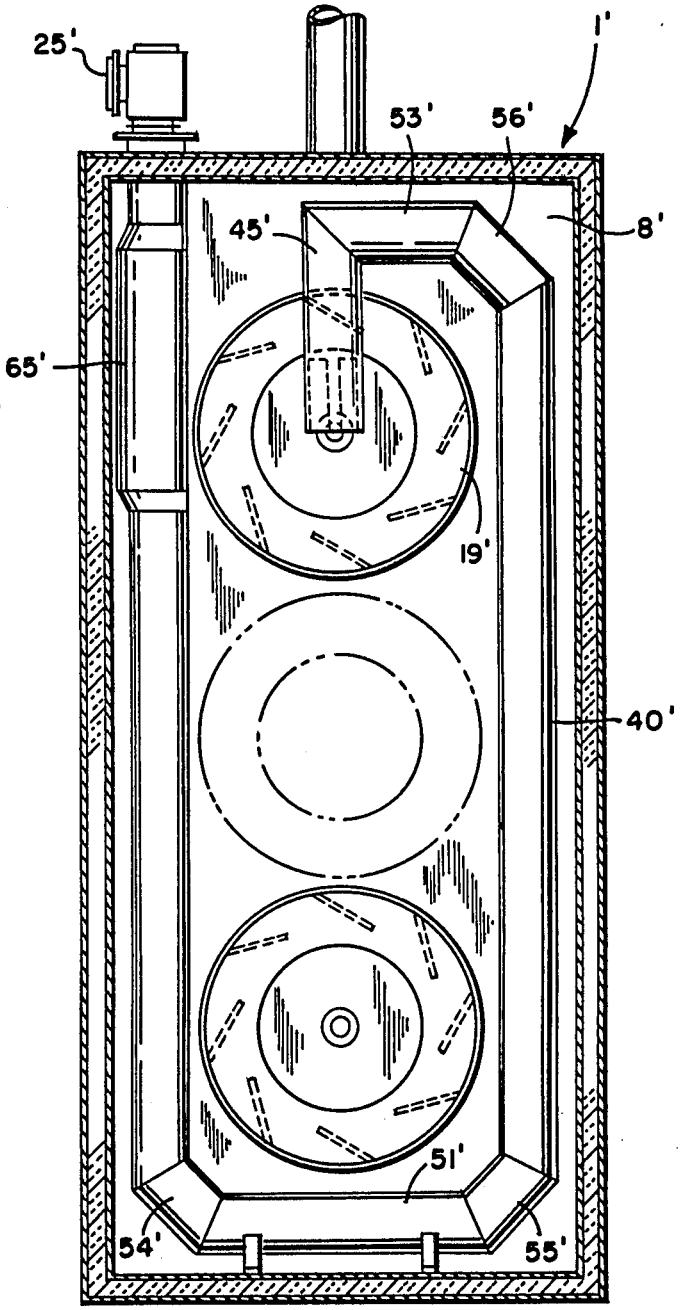
FIG. 8 is a schematic elevation view of the convection blower/heat exchanger chamber of a modified gas convection oven having plural convection blowers.

Turning briefly to FIG. 8, there is shown a modified convection blower chamber 8'. Such convection blower chamber is provided as part of a larger capacity gas convection oven 1'. The several portions of the oven 1' illustrated in FIG. 8 are designated with primed reference numerals where such parts correspond to those described above with reference to FIGS. 1–7. The height of the gas convection oven 1' is about twice that of the gas convection oven 1 and, accordingly, to provide for adequate air flow two blower wheels 19' are provided. One or more air inlet baffles 11, one being designated by the phantom line 19' in FIG. 8 directs air from the heating chamber (not shown) of the enlarged gas convection oven 1' into the convection blower chamber 8'. The heat exchanger tube 40' extends along the lengths of the front, bottom and back walls of the convection blower chamber 8' and across a portion of the top wall with an outlet 45' of the type shown in FIG. 3 opening toward the inlet to the upper blower wheel 19'. The elliptical cross section portion 65' of the heat exchanger tube 40' is of approximately the same length as that disclosed at 65 in FIG. 3 but may be extended, if necessary, to accommodate a larger flame and greater heat intensity produced by the power gas burner or package burner 25'. Operation of the gas convection oven 1' would be similar to that of the gas convection oven 1 except that both convection blower wheels 19' ordinary would be employed to effect the desired air circulation in the heating chamber (not shown).

In use of the gas convection ovens 1, 1', gas provided the power gas burner 25, for example, and air mixed with such gas is ignited and combustion occurs producing a flame that enters the heat exchanger tube portion 65. The convection blower wheel 19 is turned by the motor 20 causing air flow across the entire heat exchanger tube 40 to effect heat transfer to the air and cooling of the heat exchanger tube. Air flow follows the arrows depicting the air flow pattern, for example, in FIG. 4 tending to heat and heating chamber 7 and the food product or other material therein.

Controls 80 of conventional design may be provided adjacent the equipment chamber 9 for effecting monitoring and control of the various portions of the convection oven 1. Such controls may include the above mentioned thermostat as well as speed controls for the convection blower 19.

STATEMENT OF INDUSTRIAL APPLICATION

In view of the foregoing it will be appreciated that the invention does provide means for effecting heating of food or other material in a heating chamber 7 in a relatively highly efficient and energy efficient manner.

What is claimed is:

1. A heating system, comprising a heating compartment, a tubular heat exchanger within said heating compartment, heat input means for supplying hot fluid into said heat exchanger for flowing therein, and means for causing other fluid to flow across said heat exchanger in a direction generally transverse to the longitudinal axis of said heat exchanger for transfer of thermal energy from said heat exchanger to such other fluid flowing thereacross, said heat exchanger having an egg-shaped cross-section oriented with its narrow end facing downstream of the flow of such other fluid, said heating compartment having wall means cooperatively positioned with respect to said heat exchanger further to direct flow of such other fluid on both sides of said heat exchanger, said wall means including a wall adjacent to and generally parallel to the longitudinal axis of said heat exchanger, and the major axis of the egg-shape cross-section being oriented at an angle to the direction of flow of such other fluid and at an angle to said wall with its narrower end nearest said wall to define with such wall a restricted flow passage for such other fluid at said narrower end, whereby such other fluid flowing across said heat exchanger will be caused to flow closely over substantially the entire exterior extent thereof to maximize thermal energy transfer while minimizing heat concentration at the downstream side of the heat exchanger.

2. The system of claim 1, wherein said angle to said wall is about 45°.

* * * * *